US007469739B2

(12) United States Patent
Otero et al.

(10) Patent No.: US 7,469,739 B2
(45) Date of Patent: Dec. 30, 2008

(54) APPARATUS AND METHOD FOR REDUCING OPERATING STRESS IN A TURBINE BLADE AND THE LIKE

(75) Inventors: Edwin Otero, Southington, CT (US); Patrick Strong, Tremonton, UT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 11/654,965

(22) Filed: Jan. 18, 2007

(65) Prior Publication Data

US 2007/0131382 A1 Jun. 14, 2007

Related U.S. Application Data

(62) Division of application No. 10/763,611, filed on Jan. 23, 2004, now Pat. No. 7,216,694.

(51) Int. Cl.
*B22C 9/00* (2006.01)
*B22C 9/10* (2006.01)
*F01D 5/18* (2006.01)

(52) U.S. Cl. ..... 164/516; 164/369; 416/97 R; 415/115

(58) Field of Classification Search ..... 164/516–519, 164/122.1, 122.2, 137, 340, 369; 415/115; 416/97 R See application file for complete search history.

(56) References Cited

U.S. PATENT DOCUMENTS 4,596,281 A * 6/1986 Bishop ..... 164/32
5,296,308 A 3/1994 Caccavale et al.
5,465,780 A * 11/1995 Muntner et al. ..... 164/516
5,505,250 A 4/1996 Jago
6,119,761 A * 9/2000 Anazawa et al. ..... 164/35
D439,324 S 3/2001 Wood
6,241,469 B1 6/2001 Beeck et al.
6,257,828 B1 7/2001 Bischoff-Beiermann et al.
6,305,078 B1 10/2001 Shiga et al.
6,340,047 B1 * 1/2002 Frey ..... 164/137
6,402,476 B1 6/2002 Bossmann et al.
6,533,544 B1 3/2003 Tiemann et al.
6,533,545 B1 3/2003 Hirano et al.
6,533,547 B2 3/2003 Anding et al.
6,554,572 B2 4/2003 Rinck et al.

(Continued)

FOREIGN PATENT DOCUMENTS

EP 0585183 3/1994

(Continued)

OTHER PUBLICATIONS

European Search Report, dated Jan. 19, 2006.

*Primary Examiner*—Kevin P Kerns
(74) *Attorney, Agent, or Firm*—Carlson, Gaskey & Olds

(57) ABSTRACT

A core for casting a metal part having a body with solid portions spaced apart by hollow portions. The body includes at least one support element extending between adjacent solid portions. The support element provides stiffness and strength for the casting core during the casting process. The support element has an optimized shape to prevent the core from fracturing during the casting process and to minimize operating stress in the metal part around the area formed by the support element.

12 Claims, 7 Drawing Sheets

U.S. PATENT DOCUMENTS

| | | | | |
|---|---|---|---|---|
| 6,565,318 | B1 | 5/2003 | Tiemann | |
| 6,582,194 | B1 | 6/2003 | Birkner et al. | |
| 6,602,548 | B2 | 8/2003 | Narasimhan et al. | |
| 6,616,408 | B1 | 9/2003 | Meier | |
| 6,619,912 | B2 | 9/2003 | Tiemann | |
| 6,631,561 | B1 | 10/2003 | Anding et al. | |
| 6,638,021 | B2 | 10/2003 | Olhofer et al. | |
| 6,648,596 | B1 | 11/2003 | Grylis et al. | |
| 7,216,694 | B2 * | 5/2007 | Otero et al. | 164/516 |
| 2004/0094287 | A1 * | 5/2004 | Wang | 164/361 |
| 2007/0023157 | A1 * | 2/2007 | Otero et al. | 164/28 |

FOREIGN PATENT DOCUMENTS

| | | |
|---|---|---|
| EP | 1306147 | 5/2003 |

* cited by examiner

APPARATUS AND METHOD FOR REDUCING OPERATING STRESS IN A TURBINE BLADE AND THE LIKE

FIELD OF THE DISCLOSURE

The present disclosure generally relates to a method and apparatus for designing and manufacturing a cast part to minimize mechanical operating stress, and more particularly to minimizing operating stress in a turbine blade.

GOVERNMENTS RIGHTS IN THE INVENTION

The invention was made by or under contract with the Navy of the United States Government under contract number N00019-02-C-3003.

This application is a divisional of U.S. patent application Ser. No. 10/763,611, now U.S. Pat. No. 7,216,694, which was filed on Jan. 23, 2004.

BACKGROUND OF THE DISCLOSURE

Component casting is typically used when large quantities of identical products are being produced or when design specifications require intricate internal geometry that machining apparatus such as mills, drill presses, and/or lathes cannot access. Highly stressed components such as turbine blades in gas turbine engines require casting techniques that minimize localized stress caused by internal geometric features. Turbine blades, and the like, have internal hollow portions to reduce the weight of the blade and provide passages for cooling air flow. Cooling air flow is required because the external operating temperatures of the exhaust gas flow exceed the melting temperature of metal alloys used in gas turbine engines.

Turbine blades with cooling passages and stress reducing methods are known in the prior art. For example, U.S. Pat. No. 6,533,547 issued to Anding et al. on Mar. 18, 2003, discloses a turbine blade having internal space through which coolant fluid is guided and in which stiffening ribs are formed to reinforce and support the external walls. Coolant screens that reduce the cooling of the stiffening ribs are arranged in front of the stiffening ribs in order to reduce thermal stresses.

Cores for casting turbine blades are typically made of ceramic composite or the like. Casting cores have solid portions separated by hollow portions. The solid portions of the core form hollow portions in the final product, likewise the hollow portions of the core are where the metal portions are formed in the final product. The solid portions of the casting core will fracture if not supported adequately during the manufacturing process. To prevent core fracture, support elements or "tie features" are designed in the core to extend between adjacent solid portions. These support elements necessarily produce through apertures in the internal walls of the turbine blade. It would be desirable to design these elements to provide adequate mechanical support to the core, while at the same time minimizing operating stress that the resulting through apertures cause in the turbine blade.

SUMMARY OF THE DISCLOSURE

In accordance with one aspect of the present disclosure, a core for casting a metal part is provided. The core includes a body having solid portions spaced apart by hollow portions. The body also includes at least one support element extending between adjacent solid portions. The support element has a shape optimized to prevent the core from fracturing during the casting process and designed to minimize operating mechanical stress in the metal part formed by the support element.

In accordance with another aspect of the present disclosure, a method for designing a casting core is provided. The method defines a cross section for a support element by defining a first radius with a center point and a circumferential arc. Next, a second radius is defined with a center point and a circumferential arc positioned a first distance from the first center point. A third radius is defined by a center point and a circumferential arc positioned a second distance from the center point of the second radius. The design method further defines a fourth radius having a center point and circumferential arc positioned tangent to the circumferential arcs of the first, second, and third radii. A fifth radius having circumferential arcs positioned tangent to the circumference of the first, second and third radii and opposite of the fourth arc is also defined. The method produces a core support feature that adequately supports the core during the casting process and minimizes stress in the cast part.

In accordance with another aspect of the disclosure, a method for manufacturing a casting core is provided. The method includes providing ceramic slurry for delivery into a core die and forming a green core. The green core includes solid portions spaced apart by corresponding hollow portions. At least one support element is formed between adjacent solid portions of the core. The casting core is removed from the die and allowed to dry and then heated to a predetermined temperature to increase the material strength. The support elements are formed by defining a first radius, and a second radius a first distance from the first radius. A third radius is positioned a second distance from the second radius. A fourth radius having a circumference positioned tangent to the circumference of the first, second and third radii forms one side of a cross-section. A fifth radius having a circumference positioned tangent to the circumference of the first, second and third radii forms the opposite side of the cross section. The first and second radii can be substantially equal in length as can the fourth and fifth radii. The first and second distances can also be substantially equal in length.

In accordance with another aspect of the disclosure, a method for forming a cast part is disclosed. The method includes forming a ceramic core with at least one support element extending between adjacent solid portions of the core. The support element is formed with a cross-section designed to minimize operating stress in the cast part. A wax die is formed to define external geometry of the cast part. Wax is then injected into the wax die to form a wax pattern of the cast part. The ceramic core is placed into the wax die to produce the internal geometry of the cast part. Ceramic slurry is introduced into the wax pattern to form a mold shell. The mold is dried and the wax melts when the mold is heated to a predetermined temperature. The mold is then cooled to a predetermined temperature and preheated to at least the melting temperature of the casting material. Molten casting material is poured into the mold, and then cooled in a controlled environment. The casting mold shell is removed from the cast part. The casting is then leached with a chemical solution to remove the ceramic core from the cast part. The cast part is inspected with N-ray to check that the core has been removed. The surface of the cast is etched and a laue'ding procedure is utilized to inspect the grain structure of the cast part. The surface of the cast part is inspected with fluorescent penetrate to determine whether surface cracking exists. The internal features of the cast part are inspected with X-ray. The cast part is machined to meet the specification and is then inspected for dimensional quality. Finally, the cast part is flow tested to check the internal passages.

In accordance with a still further aspect of the disclosure, a turbine blade can be manufactured according to the method described above to produce an air foil having solid portions with at least one through aperture formed therein by the casting core. The through aperture has a shaped optimized to minimize operating mechanical stress in a localized area around the aperture. The cast metal part is formed from a casting core that includes a body having solid portions spaced apart by hollow portions and at least one support element extending between adjacent solid portions that forms a through aperture in the cast metal part.

These and other aspects and features of the disclosure will become more apparent upon reading the following detailed description when taken in conjunction with the accompanying drawings.

Figure 1:
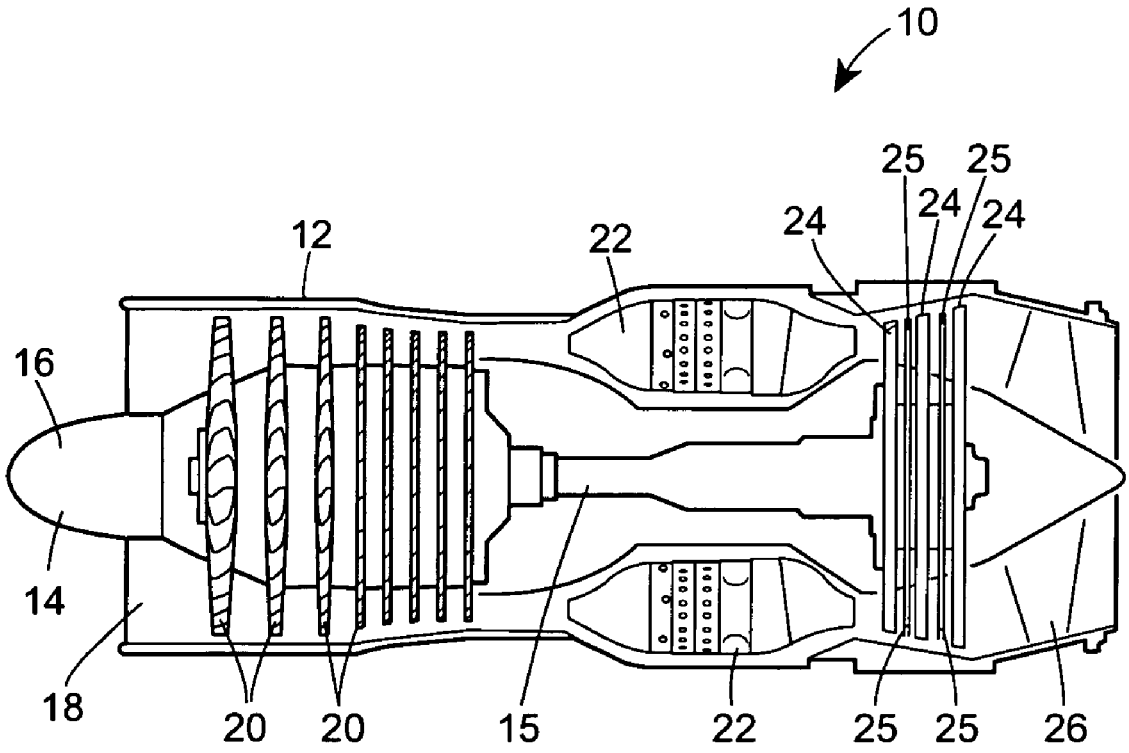
FIG. 1 is a cross-section of a typical gas turbine engine.

While the disclosure is susceptible to various modifications and alternative constructions, certain illustrative embodiments thereof have been shown in the drawings and will be described below in detail. It should be understood, however, that there is no intention to limit the present disclosure to the specific forms disclosed, but on contrary, the intention is to cover all modifications, alternative constructions, and equivalents falling within the spirit and scope of the disclosure as defined by the appended claims.

DETAILED DESCRIPTION OF THE DISCLOSURE

The present disclosure provides for an apparatus design and method for minimizing operating stress on parts manufactured by a casting process. In one embodiment of the present disclosure, the cast part is a turbine blade for a gas turbine engine, however, the cast part can be any of the type having complex internal geometry and subjected to high stresses during operation. The design and method can be used for both moving and static geometry.

Referring now to FIG. 1, a cross-section of a typical gas turbine engine 10 is shown therein. The gas turbine engine 10 includes an outer case 12 to hold the internal turbo-machinery components and to attach the engine 10 to an aerospace vehicle (not shown). The gas turbine engine 10 includes a rotor 14 that includes a shaft 15 extending from the front of the engine to the rear of the engine. The casing 12 forms an inlet 18 in which air enters past a nosecone 16 and into the engine 10. The rotor can include an axial compressor 20 having at least one stage. The compressor 20 is operable for compressing the air and delivering the compressed air to a combustor 22. The combustor 22 receives the compressed air and a fuel to burn therein. The combustion gas mixture expands at high velocity through a turbine 24 having at least one stage. A turbine stator 25 can be positioned between each turbine rotor stage to remove unsteady vortices and unstructured flow patterns to provide a predetermined velocity profile of the gas flow prior to entering the next stage of the turbine 24. A nozzle 26 accelerates the flow exiting the turbine 24 to increase the velocity mass flow which generates the thrust to propel the aerospace vehicle.

Figure 2:
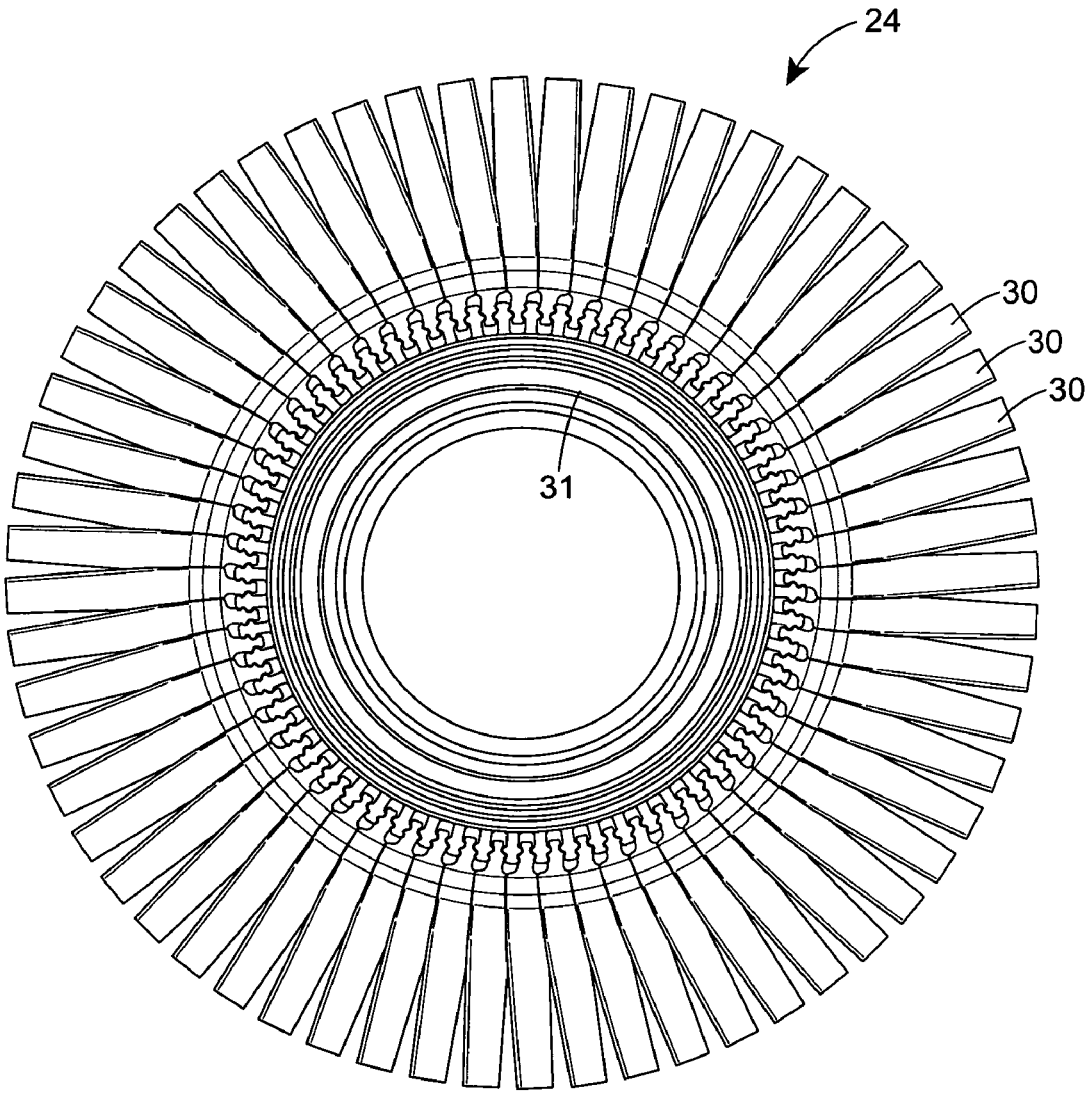
FIG. 2 is a front view of a turbine rotor.

Referring now to FIG. 2, a view of the turbine rotor is shown therein. The turbine rotor 24 has a plurality of blades 30 connected to a turbine disk 31. The turbine rotor 24 spins a high rotational speed. This high rotational speed produces a large centripetal force which creates large stresses inside the turbine blade. Additional stress is imparted on the turbine blades 30 when impacted by the high velocity air. Further stress can be generated due to thermal gradients formed during operation of the engine 10. Engine components are designed to minimize weight to achieve specified performance, but must maintain durability and reliability for a given design lifespan. To meet these performance goals and design life requirements, stress producing features such as internal holes and fillets must be designed to minimize local stress around those areas.

Figure 3A:
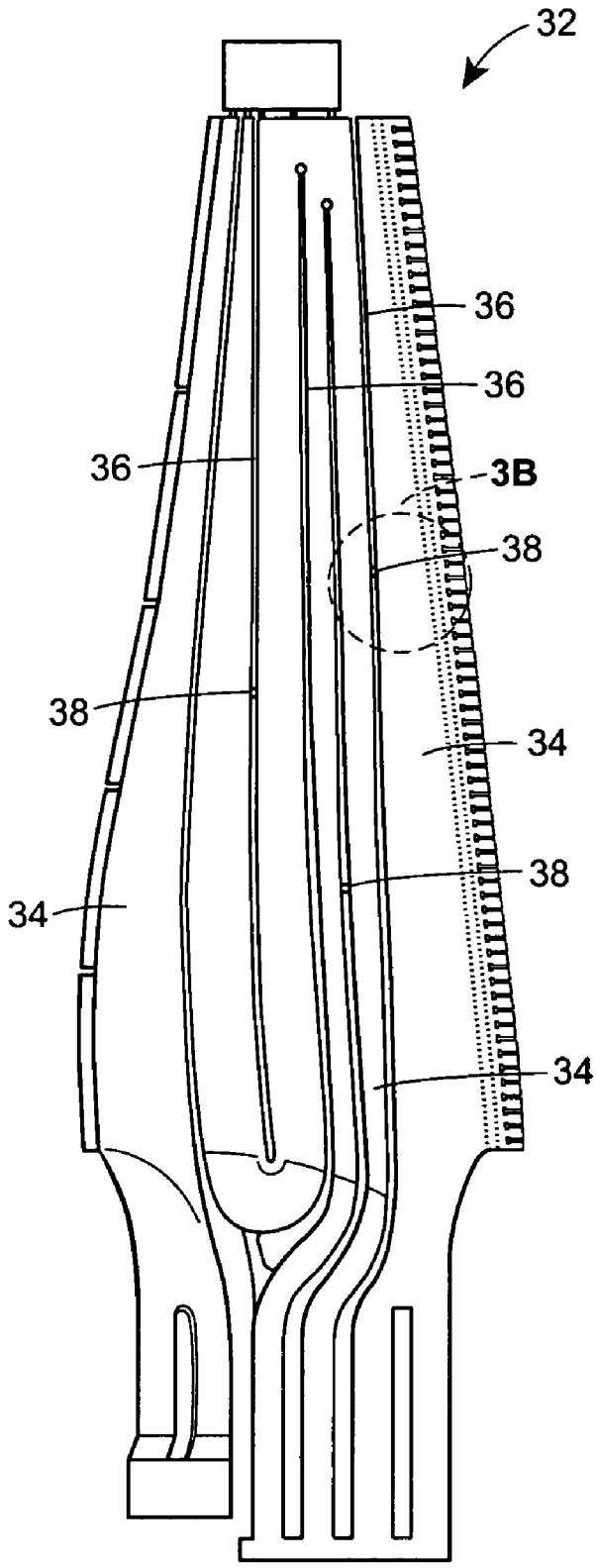
FIG. 3A is a side view of a casting core for a turbine blade.
Figure 3B:
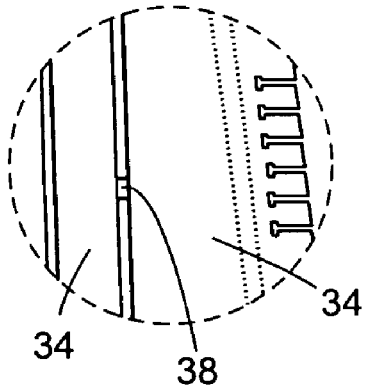
FIG. 3B is an enlarged view of a portion of FIG. 3A showing a support element.

Referring now to FIG. 3A, a casting core 32 for a turbine blade 30 is shown therein. The casting core 32 can be made of a ceramic or other composite materials designed to withstand the high temperatures and pressures generated during the casting process. The casting core produces the mirror image of itself in the final turbine blade 30. The casting core 32 has solid portions 34 spaced apart by hollow portions 36. The solid portions 34 form the internal cavities of the turbine blade 30 and the hollow portions 36 form the metal portions of the turbine blade 30. The turbine core 32 requires at least one support element 38 to extend between adjacent solid portions 34 through a hollow portion 36 to prevent the core from fracturing during the casting process. FIG. 3B shows an enlarged portion of the core 32 having a support element 38. The support element 38 has a cross-sectional shape optimized to prevent the core from fracturing during the casting process and to minimize operating mechanical stress in the area of the metal part formed by the support element 38.

Figure 4:
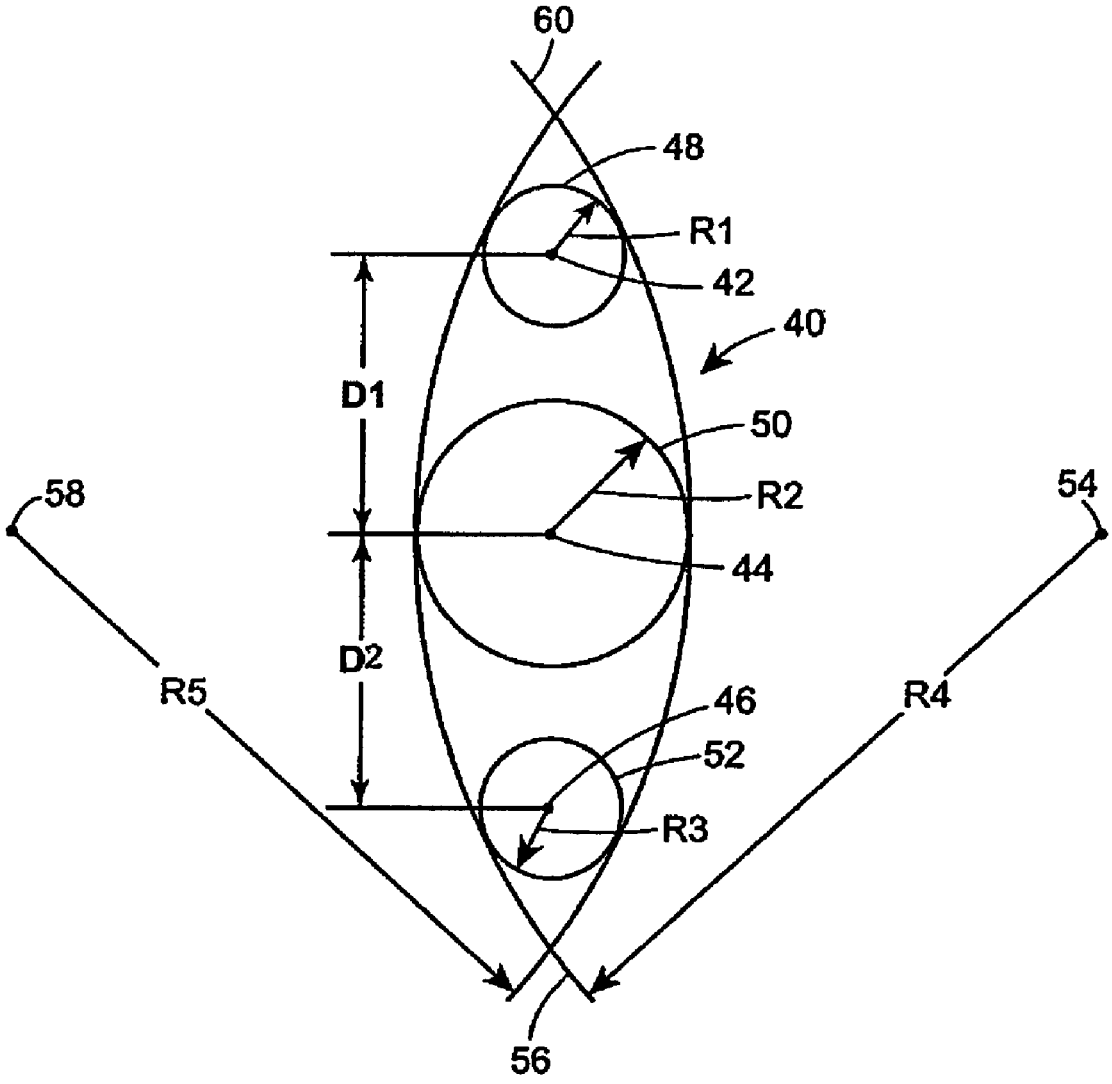
FIG. 4 is a cross-sectional view of the support element of FIG. 3A.

A cross-section 40 of the support element 38 is shown in FIG. 4. The cross-section is designed with generic curves defined below by several radii and corresponding arcs. The cross-section 40 can be scaled to a desired size for a given core 32. The cross section defines a shape that minimizes stress in the cast part. The cross-section 40 includes a first radius R1, a second radius R2, and a third radius R3 each defined by a center point 42, 44, and 46 respectively. The first radius R1 defines a circumferential arc 48, the second radius R2 defines a circumferential arc 50, and the third radius R3 defines a circumferential arc 52. The center point 42 of the first radius R1 and the center point 44 of the second radius R2 are separated by a first distance D1. The center point 44 of the radius R2 is separated a distance D2 from the center point 46 of the third radius R3. A fourth radius R4 having a center point 54 is positioned such that a circumferential arc 56 defined by the radius R4 is positioned to be simultaneously tangent to the circumferential arcs 48, 50, 52 of the first, second and third radii R1, R2, R3 respectively. A fifth radius R5 having a center point 58 defines a circumferential arc 60 that is positioned opposite of the arc 56 of the fourth radius R4. The circumferential arc 60 of the fifth radius R5 is positioned so as to be simultaneously tangent to the first, second and third circumferential arcs 48, 50, 52 of the first, second and third radii R1, R2, R3 respectively. The cross-section 40 is bounded by the arcs 56, 60 of the fourth and fifth radii on the sides thereof and by the intersection of the arcs 56, 60 of the fourth and fifth radii at each end thereof.

According to one embodiment, the first and third radii R1, R3 can be substantially equal in length and the fourth and fifth radii R4, R5 can also be substantially equal in length. Also, the first distance D1 can be substantially equal in length to the second distance D2. Each of the circumferential arcs 48, 50, 52, 56, and 60 can be defined by a higher order curve that approximates a circular arc formed by a radius. For example, the higher order curve could be a spline curve or a B-spline curve, but is not necessarily limited to those particular definitions.

In order to manufacture a casting core 32, the following method may be employed. First a ceramic slurry is injected into a core die (not shown) to form a green core. The core die forms solid portions 34 spaced apart by corresponding hollow portions 36, and at least one support element 38 extending between adjacent solid core portions. After solidifying, the core 32 is removed from the die and allowed to completely dry. After drying, the core 32 is then heated at a predetermined temperature to increase material strength. The outer surface of the core 32 is process treated to increase strength prior to machining the core to final dimensional specifications. The cross-section 40 of the at least one support element 38 may be formed according to the method described above.

A method for forming a cast part with a ceramic core having at least one support element 38 having a cross-section 40 designed to minimize operational stress in the cast part as well as provide stiffening support for the core 32 during the casting process is also contemplated by the present disclosure. The method includes forming a wax die (not shown) to define the external geometry of the cast part. The casting core 32 is inserted into the wax die. Wax is then injected into the wax die to form a wax pattern of the external shape of the cast part. Ceramic slurry is then introduced into the wax pattern to form a mold shell. The mold is dried and the wax is removed by heating the mold to a predetermined temperature to melt the wax. This heating process also increases the strength of the ceramic mold. The ceramic mold is cooled to a predetermined temperature and then preheated to the approximate melting temperature of the casting material. The molten casting material is then poured into the mold. The mold is cooled in a controlled environment. The casting mold shell is removed from the cast part and the casting core 32 is leached with acid of a type known in the art to remove the ceramic core from the cast part. The cast part is then inspected with N-ray to verify that all of the core material has been removed. The surface of the cast part is etched and a laue'ding procedure is performed to inspect the grain structure of the cast part and ensure structural integrity. The surface of the cast part is then inspected with a fluorescent penetrate to determine whether any flaws such as cracks have formed. The internal features of the east part are inspected with X-ray. The cast part is then finish machined and inspected to final external dimensions. A flow test is performed to determine whether the internal passages were formed correctly.

Figure 5:
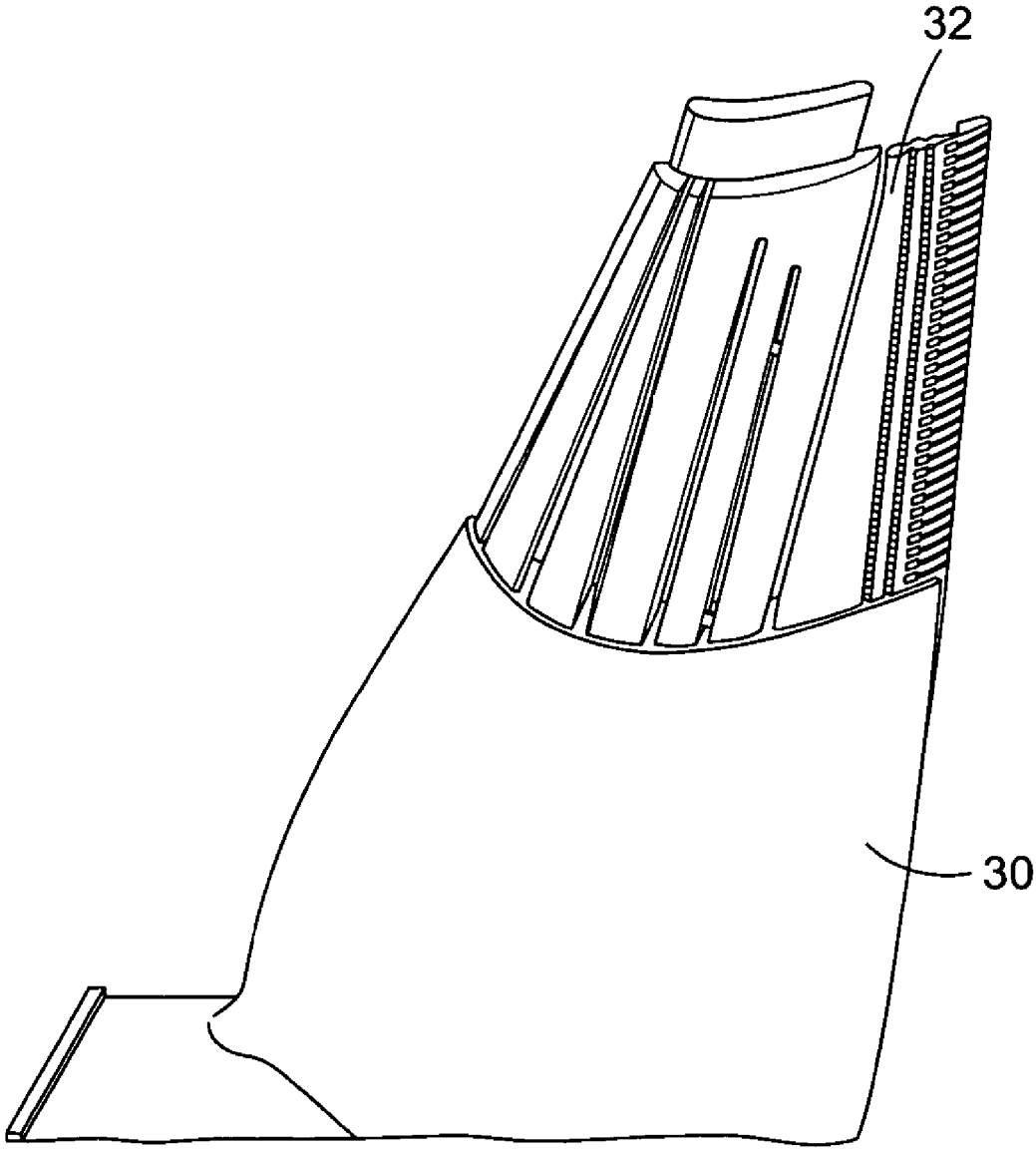
FIG. 5 is a perspective view rotor blade partially cut-away to show the casting core of FIG. 3A.
Figure 6:
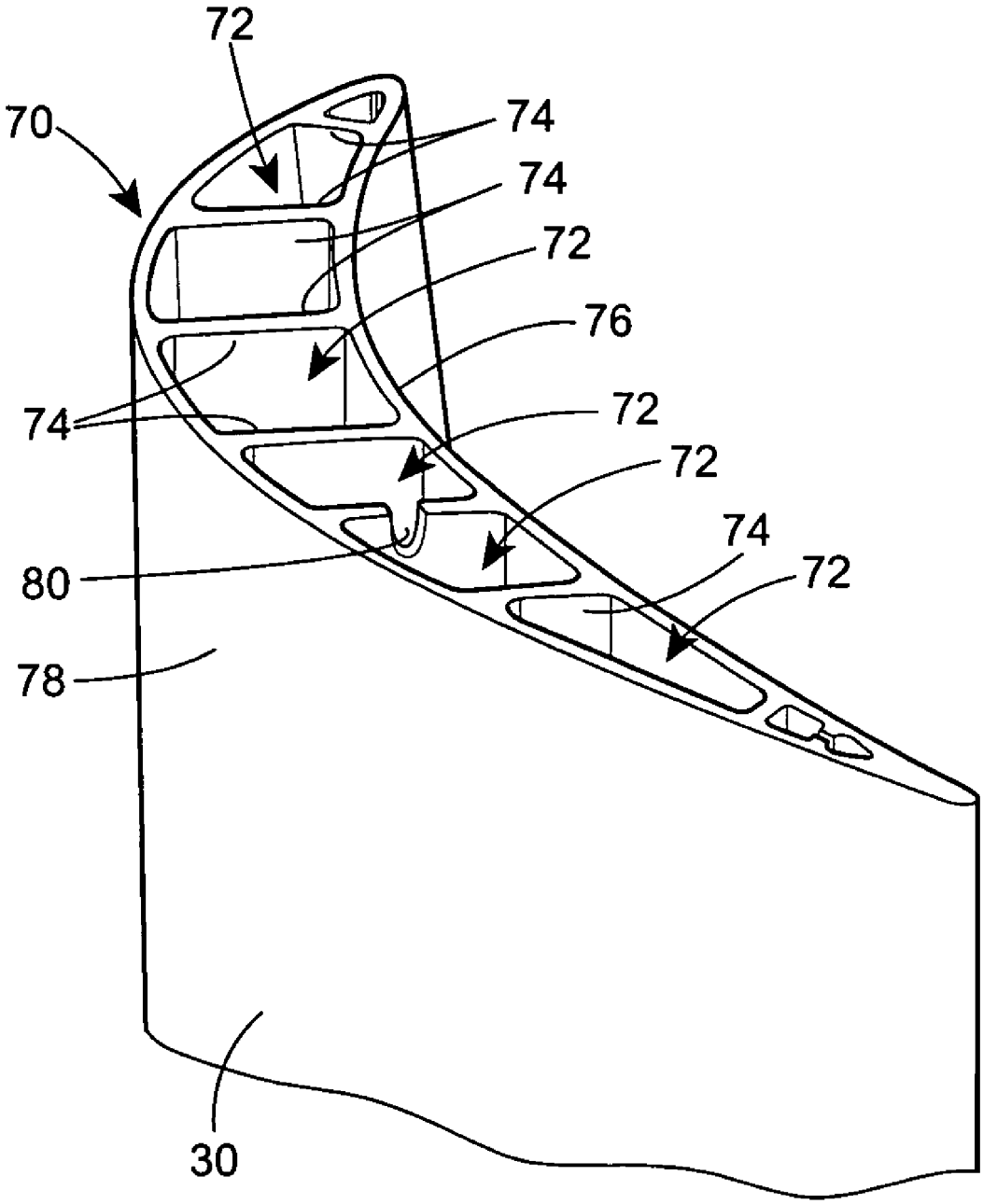
FIG. 6 is a portion of the cast turbine blade after the core has been removed to show internal passages of the turbine blade.

Referring now to FIG. 5, a turbine blade 30 is shown partially cut-away with the ceramic core 32 shown internal thereto. FIG. 6 shows an internal structure 70 of the turbine blade 30 after the ceramic core 32 has been removed. More specifically, a plurality of passages 72 is formed in the turbine blade 30 to provide channels for cooling air flow to circulate therein and keep the blade 30 below the design temperature limit. Each cooling passage 72 includes a pair of side walls 74 bounded by the external suction and pressure walls 76, 78 of the blade 30. Each core support element 38 forms a through aperture 80 in the side walls 74 of the air passages 72. These apertures 80 cause high stress in localized areas surrounding the aperture 80. As such, it is desirable that the shape of the apertures 80 are designed to minimize the localized stress in the blade 30 according to the method described above.

Figure 7A:
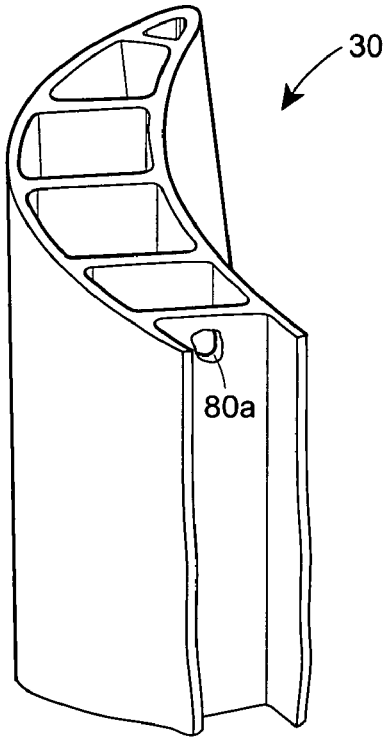
FIG. 7A is a portion of the turbine blade showing an irregular aperture formed from an undefined casting support element.
Figure 7B:
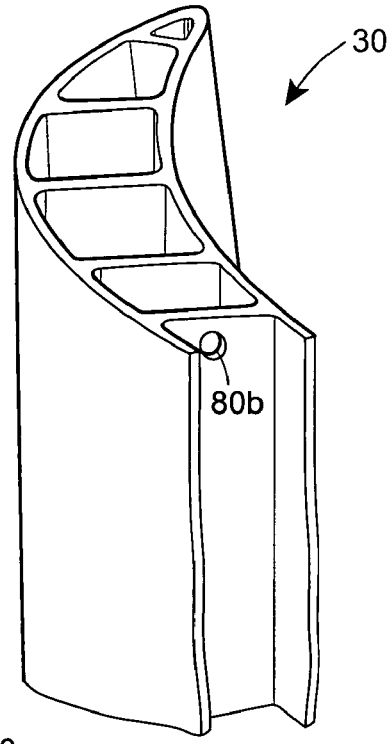
FIG. 7B is a portion of the turbine blade showing an circular aperture formed from a casting support element having a circular cross section.
Figure 7C:
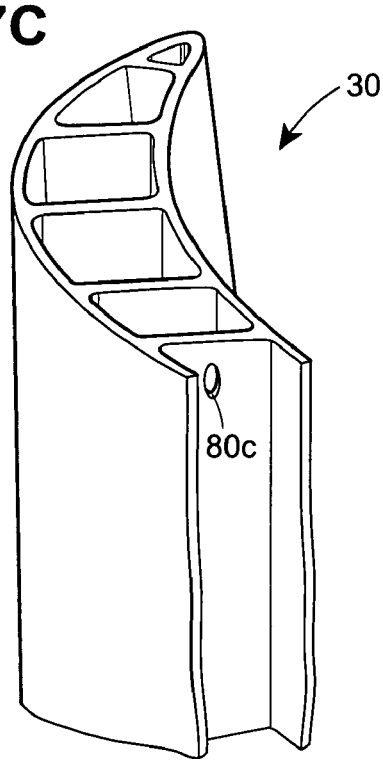
FIG. 7C is a portion of the turbine blade showing an aperture formed from a casting support element having a cross section defined by the present disclosure.

FIG. 7A shows a portion of a turbine blade 30 having an irregular aperture 80*a* formed from an undefined casting support element 38. FIG. 7B shows a portion of a turbine blade 30 having a circular aperture 80*b* formed from a casting support element having a circular cross section. FIG. 7C shows a portion of a turbine blade 30 with an aperture formed from a casting support element having a cross section defined by the present disclosure. The turbine blade 30 of FIG. 7C was analyzed using Finite Element Analysis (FEA), a computational design tool that allows design engineers to model a particular part and simulate operational loads such as inertial forces, thermal gradients, pressure forces, and the like. The FEA model analytically breaks the solid part into a series of discreet geometric elements such as "bricks" or "tetrahedrons", etc, and calculates the stress at each element induced by the simulated operational loads. The design study performed lead to the discovery that stress levels associated with the aperture 80*c* having the newly designed geometry of FIG. 7C were approximately 50% of the stress levels associated with the apertures 80*a*, 80*b* shown in FIGS. 7A and 7B.

While certain representative embodiments and details have been shown for purposes of illustrating the disclosure, it will be apparent to those skilled in the art that various changes in the methods and apparatus disclosed herein may be made without departing from the scope of the disclosure, which is defined in the appended claims.

What is claimed is:

1. A turbine blade:

the blade formed by forming a ceramic core with at least one support element extending between adjacent solid portions spaced apart by a corresponding hollow section, the at least one support element having a shape optimized to prevent the core from fracturing during a casting process and to minimize operating mechanical stress in the area of the metal part formed by the support element;

making a wax die to define external geometry of the cast part;

injecting wax into the wax die to form a wax pattern of the cast part;

inserting the ceramic core into the wax pattern;

injecting ceramic slurry into the wax pattern to form a mold shell;

drying the mold shell;

removing the wax from the mold;

heating the mold to a predetermined temperature to increase the strength of the ceramic mold;

cooling the mold to a predetermined temperature;

preheating the mold to melting temperature of the casting material;

pouring molten casting material into the mold;

cooling the mold in a controlled environment;

removing the casting mold shell from the cast part;

leeching the core from the cast part;

inspecting the part with N-ray to verify that the entire core has been removed;

etching the surface of the cast part;

laue'ding and inspecting the grain structure of the cast part;

inspecting the surface of the cast part with fluorescent penetrate;

inspecting internal features of the cast part with X-ray;

finish machining the external features of the cast part;

inspecting the external dimensions of the cast part;

flow testing the internal passages of the cast part;

providing an airfoil having solid portions with at least one through aperture formed therein by a casting core, said airfoil having internal cooling passages, with separating walls defined between said cooling passages, and said at least one aperture extending from one cooling passage, through a separating wall to another cooling passage, the at least one aperture having a shape optimized to minimize operating mechanical stress in a localized area around the aperture, said shape of said at least one aperture including a cross-sectional shape having a thickness at a central location that is greater than a thickness at either side of said cross-sectional shape; and said cross section having a first radius, a second radius, a third radius, a fourth radius, and a fifth radius, each radius defined by a center point and a circumferential arc, a first distance defining a length between the center point of the first radius and the center point of the second radius, and a second distance defining a length between the center point of the second radius and the center point of the third radius, and with said first, second, third, fourth, and fifth radii being utilized to form said shape of said at least one aperture, with said second radii at least partially forming said central location, and said first and third radii being utilized to form said sides of said cross-sectional shape.

2. The turbine blade of claim 1, wherein the first and third radii are substantially equal in length.

3. The turbine blade of claim 1, wherein the fourth and fifth radii are substantially equal in length.

4. The turbine blade of claim 1, wherein the first distance is substantially equal to the second distance.

5. The turbine blade of claim 1, wherein the center point of the fourth radius is positioned such that the circumferential arc of the fourth radius is simultaneously tangent to the circumferential arcs of the first, second, and third radii.

6. The turbine blade of claim 1, wherein the center point of the fifth radius is positioned such that the circumferential arc of the fifth radius is simultaneously tangent to the circumferential arcs of the first, second, and third radii.

7. The turbine blade of claim 1, wherein the circumferential arcs of the fourth and fifth radii define opposing sides of the core cross-section.

8. The turbine blade of claim 1, wherein each circumferential arc is defined by a higher order curve that approximates a radius.

9. The turbine blade of claim 8, wherein the higher order curve is a spline.

10. The turbine blade of claim 8, wherein the higher order curve is a B-spline.

11. The turbine blade of claim 1, wherein the core is made from ceramic composite material.

12. A component for a gas turbine engine comprising:

an airfoil body having a plurality of cooling passages extending in a direction from a platform toward a tip of the airfoil, there being a suction wall and a discharge wall, with said cooling passages being defined between said walls and separating walls separating said cooling passages; and at least one aperture formed through at least one of said separating walls and connecting at least two of said cooling passages, said aperture having a shape optimized to minimize operating mechanical stress in a localized area around the aperture, said shape of said at least one aperture including a cross-sectional shape having a thickness at a central location that is greater than a thickness at either side of said cross-sectional shape, the cross-sectional shape having a first radius, a second radius, a third radius, a fourth radius, and a fifth radius, each radius defined by a center point and a circumferential arc, a first distance defining a length between the center point of the first radius and the center point of the second radius, and a second distance defining a length between the center point of the second radius and the center point of the third radius, and with said first, second, third, fourth, and fifth radii being utilized to form said cross-sectional shape of said at least one aperture, with said second radii at least partially forming said central location, and said first and third radii being utilized to form said sides of said cross-sectional shape.

* * * * *